US007187900B2

(12) United States Patent
Fuma et al.

(10) Patent No.: US 7,187,900 B2
(45) Date of Patent: Mar. 6, 2007

(54) IMAGE FORMING APPARATUS HAVING A FIXING DEVICE FOR FIXING TONER IMAGE FORMED ON A SHEET BY AN ENDLESS FIXING BELT ENGAGED WITH A FIXING ROLLER

(75) Inventors: Hiroshi Fuma, Uenohara-machi (JP); Yoshio Yamazaki, Tokyo (JP); Junichi Hamada, Hachioji (JP); Hisayoshi Nagase, Hachioji (JP); Masahiro Onodera, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 245 days.

(21) Appl. No.: 10/891,887

(22) Filed: Jul. 15, 2004

(65) Prior Publication Data

US 2005/0111862 A1 May 26, 2005

(30) Foreign Application Priority Data

Nov. 21, 2003 (JP) ..... 2003-391891

(51) Int. Cl.
*G03G 15/20* (2006.01)

(52) U.S. Cl. ..... 399/329; 399/67; 399/341

(58) Field of Classification Search ..... 399/67, 399/324, 328, 329, 341
See application file for complete search history.

(56) References Cited

U.S. PATENT DOCUMENTS 5,873,020 A * 2/1999 Matsuura et al. ..... 399/329
5,887,235 A * 3/1999 Wayman et al. ..... 399/329
5,998,761 A * 12/1999 Berkes et al. ..... 399/328 X
6,577,837 B2 * 6/2003 Iida et al. ..... 399/329 X

* cited by examiner

*Primary Examiner*—Sandra L. Brase
(74) *Attorney, Agent, or Firm*—Cantor Colburn LLP

(57) ABSTRACT

An image forming apparatus comprising a fixing roller, an endless fixing belt engaged at least with the fixing roller, and a pressing roller opposite to the fixing roller with the endless fixing belt between them; wherein the image forming apparatus is equipped with a pressure changing member for changing the mean pressure on a second pressing area against which the pressing roller pressed the fixing roller via the fixing belt in the pressure area formed by the pressing roller.

20 Claims, 4 Drawing Sheets

IMAGE FORMING APPARATUS HAVING A FIXING DEVICE FOR FIXING TONER IMAGE FORMED ON A SHEET BY AN ENDLESS FIXING BELT ENGAGED WITH A FIXING ROLLER

BACKGROUND OF THE INVENTION

This invention relates to a fixing device having a fixing belt and an image forming apparatus having the fixing belt for image formation used for an electrophotographic copying machine, printer, facsimile, and so on.

Recently, the world has been increasing the demand of higher image qualities in the electrophotographic image forming apparatus such as copying machines, printers, facsimile equipment, and the like. Fixing devices of some image forming apparatus have been demanded to make images glossier or controlled.

Conventionally, thermal roller fixing devices have been well known as fixing devices. A thermal roller fixing device is equipped with a heating rubber roller which has an elastic layer around it and is controlled to keep it at a preset temperature and a pressing rubber roller which is in contact with the heating rubber roller and has an elastic layer around it. A recording sheet having an unfixed toner image on it is sandwiched, heated and transferred by these heating and pressing rubber rollers. During the movement of the sheet, the toner image on the sheet is fixed.

However, in such a thermal roller fixing device, the heating rubber roller has a great heat capacity and takes a long warm-up time. Further, the inner side of the elastic layer is heated too much. This shortens the service life of the heating rubber roller.

To solve the above problems, belt-type fixing devices using an endless belt member (a fixing belt) have been also known. The fixing belt of the belt-type fixing device is engaged with a fixing roller and a heating roller having a heating means to heat the fixing belt. The belt-type fixing device is further equipped with a pressing roller which provided opposite to the fixing roller with the fixing belt between them. A recording sheet having an unfixed toner image on it is sandwiched, heated and transferred by the fixing belt and the pressing roller. During the movement of the sheet, the toner image on the sheet is fixed.

Simultaneously, a single image forming apparatus has been demanded to form images of different degrees of glossiness such as color photo images, OHP images, and mono-chromatic character images.

In an image fixing method using a heating roller, the fixing performance such as a fixing ability (adhesion of toner to recording sheets) and a degree of glossiness is singly determined by a pair of fixing and pressing rollers. Therefore, when the pressure is varied to change the degree of glossiness, the fixing nip width or the fixing time is also varied. This affects the other fixing performance.

This is because the fixing function is concentrated to a single point and consequently limits the exact variation of degree of glossiness.

Contrarily to the image fixing method using a heating roller, some technologies below have been proposed to enable the belt fixing method to vary the degree of glossiness.

One technology consists of steps of detecting the degree of glossiness of a manuscript, varying the airflow rate of the fan to cool the fixing device and a point at which a transfer medium separates from the fixing belt according to the detected information of glossiness, changing the fixing temperature and time thereby, and thus getting a desired degree of glossiness of an image. This technology is disclosed, for example, by Japanese Non-examined Patent Publication H5-333643.

However, by this technology using a cooling means to change the airflow rate, an exact glossiness control cannot be expected because the cooling ability is affected by the environmental temperature change. Further, when the above-described separation point is changed, the sheet delivery path varies and this affects the sheet delivery characteristic.

Another technology consists of steps of changing the fixing speed and the fixing temperature according to a Glossy image mode, an OHP image mode, or a Non-glossy mode by a preset program and getting desired glossiness. This technology is disclosed, for example, by Japanese Non-examined Patent Publication 2001-282034.

However, this technology reduces the productivity of images of the image forming apparatus when the fixing speed is reduced. Similarly, when a temperature change is required, it takes a lot of time to change the temperature. This also reduces the image productivity of the image forming apparatus.

A still another technology gets a desired degree of image glossiness by calculating a desired temperature of the heating roller from an entered glossiness mode, a detected temperature of the pressing roller, a load nip time, etc. and controlling the heat source for the heating roller to this desired roller temperature. This technology is disclosed, for example, by Japanese Non-examined Patent Publication 2003-149987.

However, this technology reduces the productivity of images of the image forming apparatus as it takes a lot of time to change the temperature of the heating roller.

SUMMARY OF THE INVENTION

The image forming apparatus and the fixing device have the configurations below.

(1) An image forming apparatus comprising a fixing roller, an endless fixing belt engaged at least with the fixing roller, a pressing roller opposite to the fixing roller through the endless fixing belt; wherein a pressure area pressed by the pressing roller has of a first pressure area in contact with the fixing belt where the pressing roller does not press the fixing belt against the fixing roller and a second pressure area which is provided in the downstream side of the movement of a recording sheet and pressed the fixing roller through the endless fixing belt, and a pressure changing member that varies the mean pressure on the second pressure area. Or (2) An image forming apparatus comprising a fixing roller, an endless fixing belt engaged at least with the fixing roller, and a pressing roller opposite to the fixing roller through the endless fixing belt, wherein a pressure area pressed by the pressing roller has a first pressure area in contact with the fixing belt where the pressing roller does not press the fixing belt against the fixing roller and a second pressure area which is provided in the downstream side of the movement of a recording sheet and pressed the fixing roller through the endless fixing belt, and fixing condition is controlled to suppress under-offsetting in the first pressure area. Or (3) A fixing device comprising a fixing roller, an endless fixing belt engaged at least with the fixing roller, a pressing roller opposite to the fixing roller through the endless fixing belt; wherein a pressure area pressed by the pressing roller has a first pressure area in contact with the fixing belt where the pressing roller does not press the fixing belt against the fixing roller and a second pressure area which is provided in the downstream side of the movement of a recording sheet and pressed the fixing roller through the endless fixing belt, and a pressure changing member that varies the mean pressure on the second pressure area.

The inventors paid notice to that the belt fixing device has two pressure areas and thought that the belt fixing device mainly gives a fixing property to a sheet by the first pressure area and a glossiness by the second pressure area. Judging from this, they thought they could control the fixing property and the glossiness in the belt fixing device.

As the result, we found that we could control image quality and glossiness quickly and widely by providing the belt fixing device with a pressure changing member that changes the mean pressure on the second pressure area.

We can get high-quality images free of image misalignment by setting the belt fixing device to suppress under-offsetting in the first pressure area.

In this specification, "under-offsetting" means a phenomenon that toner T on a recording sheet K attaches to the surface of the fixing belt before the toner is fused and fixed to the sheet K in the first pressure area.

DETAILED DESCRIPTION OF THE PREFERRED EMBODIMENTS

Figure 1:
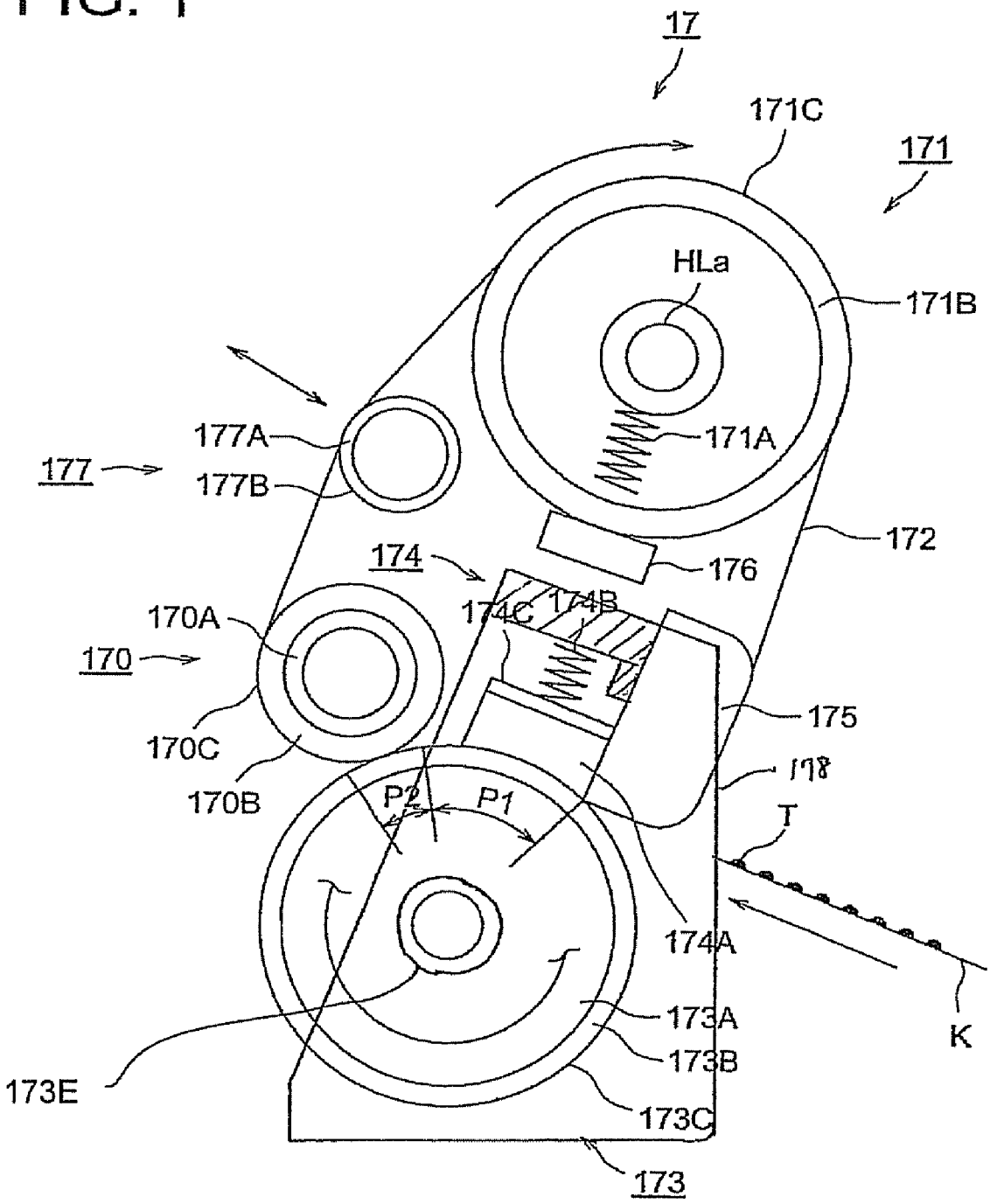
FIG. 1 is a schematic sectional drawing of the belt fixing device.

This invention will be described in further detail by way of an embodiment. It is to be understood that the description below is not intended to limit the technical range of claims and meanings of terms. Further, the assertive explanation of the preferred embodiments of this invention indicates the best mode and is not intended to limit the meanings of terms and technical range of claims of this invention.

Below will be explained an image forming apparatus using a fixing device of this invention with reference to FIG. 2. FIG. 2 is a vertical sectional view of an image forming apparatus. Same reference characters designate corresponding parts in the FIG. 1 and other drawings.

Referring to FIG. 2, the image forming apparatus GS has the main an image forming apparatus body GH and an image scanning device SC mounted on the top of the main body GH.

The image forming apparatus body GH is generically called a tandem type color image forming apparatus. The main body GH arranges yellow, magenta, cyan, and black image forming units to form color toner images along the movement of an intermediate transfer medium. The main body GH transfers each color toner image formed on the image retainer of each image forming unit onto a single intermediate transfer medium to superimpose thereof, and then transfers a multi-color toner image onto a transfer medium (sheet) at a time.

Referring to FIG. 2, a manuscript image placed on the image scanning device SC mounted on the top of the main body GH is optically scanned by an optical system, and read into a line image sensor CCD. The optical scanned signal is converted into an analog signal by the line image sensor CCD and sent to an image processor. The image processor performs analog processing, A/D conversion, shading correction, image compression, etc. on the analog signal and sends the processed signal to an exposure optical system 3 which is an image writing means.

Referring to FIG. 2, four process units 100 are provided to form yellow (Y), magenta (M), cyan (C), and black (BK) images near the intermediate transfer belt 6 which is the intermediate transfer medium. The four process units 100 are serially disposed along the movement of the intermediate transfer belt 6 which runs vertically in the arrow direction. In other words, the units 100 are disposed in the order of Y, M, C, and BK in the rotation of the intermediate transfer belt 6.

The four yellow, magenta, cyan, and black process units 100 are identical in the configuration. Each process unit 100 consists of a photosensitive drum 1 which works to retain an image, a charger 2 which works as a charging means, an exposure optical system 3 which works as an image writing means, a developer 4 which works as an image developing means, and a photosensitive drum cleaner 190 which works as an image retainer cleaning means.

The photosensitive drum 1 includes a cylindrical base of, for example, about 40 mm to 100 mm in the outer diameter which is made of a metallic member such as aluminum and a photoconductive layer of about 20 μm to 40 μm thick which is made of organic photosensitive material and formed on the surface of the cylindrical base. The photosensitive drum 1 revolves in the arrow direction.

An image forming section comprising a set of a charger 2, an exposure optical system 3, and a developer 4 is placed around the photosensitive drum 1. The charger 2, the exposure optical system 3, and the developer 4 are disposed in this order in the rotation of the photosensitive drum 1.

The charger 2 is provided opposite to the photosensitive drum 1 and across the rotation of the drum (perpendicularly to this drawing). The charger 2 is equipped with a discharging wire as a corona discharging electrode to give a preset potential to the organic photosensitive layer of the photosensitive drum 1. The charger 2 gives a uniform potential to the surface of the photosensitive drum 1 by corona discharging of the same polarity as that of the toner.

The exposure optical system 3 drives a laser light emitted from a semiconductor laser LD (not shown in FIG. 2) to scan in the main scanning direction by a rotary polyhedral mirror (without a reference character), sends the scanned light to the surface of the photosensitive drum 1 through a fθ lens (without a reference character) and a reflection mirror (without a reference character) to electrostatically write an image on the surface of the photosensitive drum 1 (image formation) by an electric signal corresponding to the image signal. In other words, the exposure optical system 3 forms an electrostatic latent image corresponding to the manuscript image on the photosensitive layer provided on the surface of the photosensitive drum 1.

The developers 4 contains a 2-component developing agent (yellow (Y), magenta (M), cyan (C), or black (BK)) which is charged with the same polarity as the charging polarity of the photosensitive drum 1 and is equipped with a developing roller 4*a* that retains the developing agent. The developing roller 4*a* is spaced a preset distance from the photosensitive drum 1 by a buffing roller (not shown in FIG. 2) and rotates in the same direction as the rotation of the photosensitive drum 1. During development, a D.C. voltage of the same polarity as that of the toner or a developing bias voltage that superimposes an A.C. voltage and an A.C. voltage is applied to the developing roller 4*a*. This inversely develops the exposed image on the photosensitive drum 1.

The intermediate transfer belt 6 is made of a half-conductive endless (seamless) plastic belt member having a volume resistivity of about 1E+7 to 1E+9 Ω.cm and a surface resistivity of 1E+10 to 1E+12 Ω/cm. The intermediate transfer belt 6 is supported and moved vertically by a plurality of roller members including a tension roller 6*a*. The intermediate transfer belt 6 can be a drum-like member.

The primary transfer roller 7 as a first transfer means of each color is made of, for example, a conductive roller-shaped material of foamed rubber such as silicone or urethane. Each primary transfer roller 7 is provided opposite to the each photosensitive drum 1 with the intermediate transfer belt 6 between them. Each primary transfer roller 7 presses the intermediate transfer belt 6 on the back to form a transfer area between the photosensitive drum 1 and the primary transfer roller 7. A D.C. constant current of a polarity opposite to that of the toner is applied to the primary transfer roller 7 by a constant current control. This forms a transfer electric field in the transfer area and transfers the toner image from the photosensitive drum 1 onto the intermediate transfer belt 6.

Below will be explained an image forming process.

At the start of image recording, the motor for driving the photosensitive member starts and the photosensitive drum 1 of yellow (Y) rotates in the arrow direction. The charger 2 of yellow (Y) gives a potential to the photosensitive drum 1 of yellow (Y). The exposure optical system 3 of yellow (Y) writes an image (by exposing) by a first color signal or an electric signal corresponding to a yellow image data. This forms an electrostatic latent image corresponding to the yellow image on the yellow photosensitive drum 1. The latent image Y is inversely developed by the developer 4 and a toner image of yellow toner is formed on the yellow photosensitive drum 1. The yellow toner image on the yellow photosensitive drum 1 is transferred onto the intermediate transfer belt 6 by the primary transfer roller 7 which works as a primary transfer means.

In a process similar to the above, magenta (M), cyan (C), and black (BK) toner images are superimposed in sequence on the intermediate transfer belt 6 to form a multi-color image.

After transferring, the remaining toners are wiped off from the photosensitive drums 1 by the drum cleaners 190 which respectively work as an image retainer cleaning means.

Recording sheets K stored in the paper feed cassettes 20A, 20B, and 20C are respectively taken out from the paper feed cassettes by take-up rollers 21 and feed rollers 22A in each paper feed cassettes 20A, 20B, and 20C. A recording sheet K taken out from the cassette is sent to the secondary transfer roller 7A which works as a secondary transfer means to which a voltage of a polarity opposite to that of the toner is applied by means of delivery rollers 22B, 22C, 22D, and resist rollers 23. The multi-color toner image formed on the intermediate transfer belt 6 is transferred onto a recording paper K at a time in the transfer area of the secondary transfer roller 7A.

The multi-color image on the recording sheet K is fixed by an image fixer 17 (to be explained). The sheet K is then held by the ejection rollers 24 and ejected onto the paper tray 25 outside the image forming apparatus.

After the multi-color image is transferred onto the recording sheet K by the secondary transfer roller 7A, the recording sheet K is bent and separated from the intermediate transfer belt 6. The remaining toners are wiped off from the intermediate transfer belt 6 by the belt cleaner 190*a* which works as a means to clean the intermediate transfer member.

In the above description, a color image formation is explained, but this invention is also applicable to a monochromatic image formation.

Below will be explained an image fixer 17 related to this invention with reference to FIG. 1.

Figure 2:
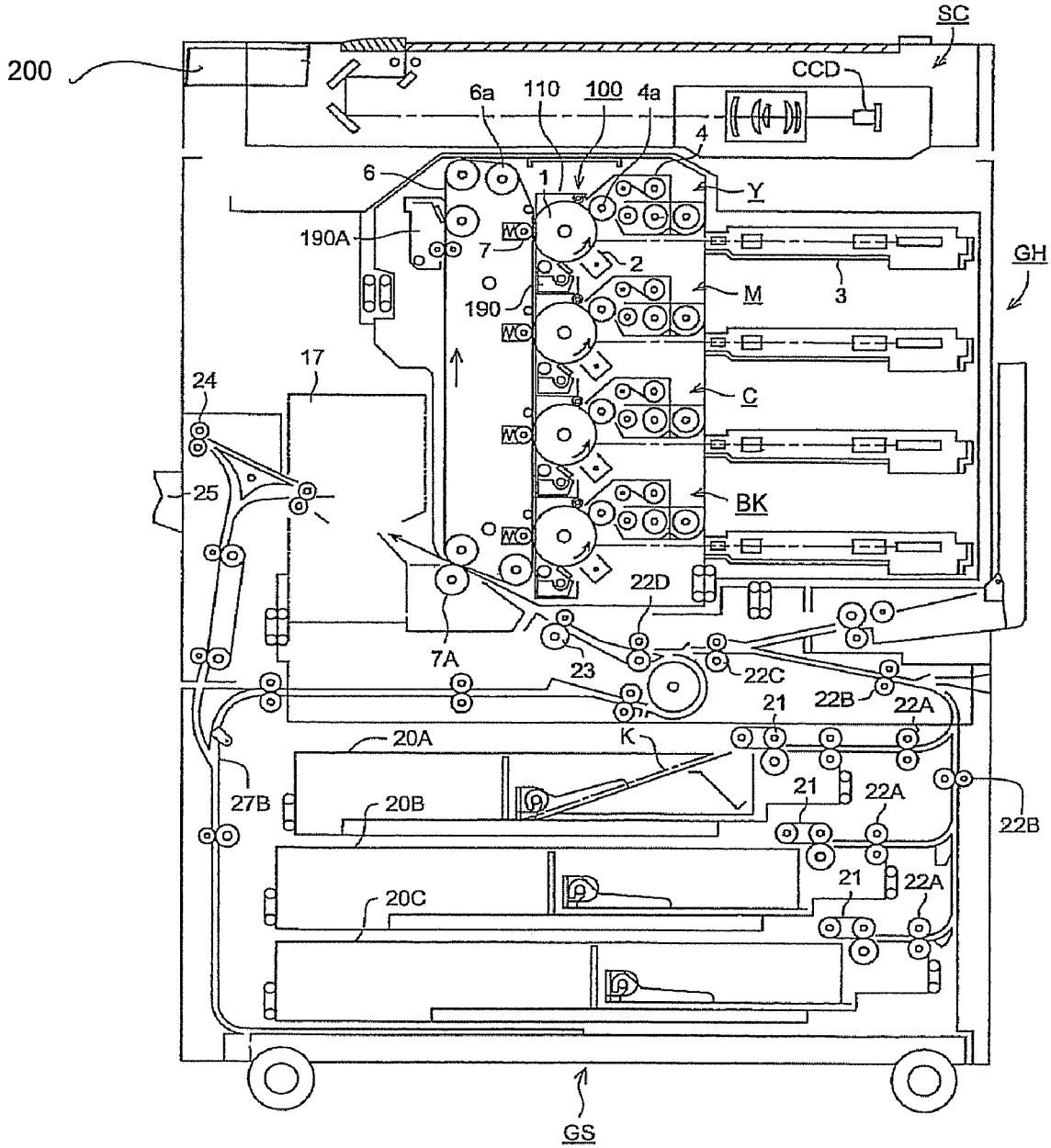
FIG. 2 is a vertical sectional view of an image forming apparatus.

Referring to FIG. 1, the endless fixing belt 172 is engaged with a fixing roller 170, a heating roller 171, a guide member 175, and a guide roller 177 and adequately tensioned by compression springs 171A.

The pressing roller 173 is provided opposite to the fixing roller 170 with the fixing belt 172 between them and pressed against the fixing roller 170 by a means to be explained later.

The guide member 175 is provided to form a first pressure area P1 between the fixing roller 170 and the guide member 175 at which the fixing belt 172 is in contact with the pressure roller 173.

Further, a second pressure area P2 is formed in the downstream side of sheet movement from the first pressure area P1 at which the fixing roller 173 presses the fixing roller 170 with the fixing belt 172 between them.

The roller 170 is driven by a driving means (not shown in the figure) to rotate in the arrow direction and rotate the heating roller 171, the pressure roller 173, and the guide roller 177 in a preset direction by means of the fixing belt 172.

The fixing roller 170 is a soft roller of 30 to 50 mm in the outer diameter. For example, a preferred embodiment of the fixing roller 170 consists of a cylindrical metallic pipe 170A made of SC steel (STKM) of 2 to 5 mm thick, an elastic layer 170B of about 3 to 10 mm thick made of, for example, silicone material having a rubber hardness of 5 to 60 Hs (by JIS K6253 "A" rubber hardness (ISO48 7619)), and a releasing layer 170C made of a PFA (perfluoroalkoxy) tube of 15 to 70 μm thick which covers the elastic layer 170B.

The heating roller 171 is 40 to 60 mm in the outer diameter. A preferred embodiment of the heating roller 171 includes a cylindrical metallic pipe 171B of 1 to 2 mm thick made of aluminum, a releasing PFA layer 171C of 15 to 50 μm thick which covers the metallic pipe 171B, and a halogen lamp HLa provided inside the metallic pipe 171B.

The base of the fixing belt 172 is an endless metallic belt (e.g. nickel type belt) of about 20 to 80 μm thick or a heat-resistant plastic belt (e.g. polyimide or polyamide belt) of about 40 to 150 μm thick. The outer surface (periphery) of the fixing belt base 172 is coated with an insulating silicone rubber of 100 to 300 μm thick. Further, the fixing Belt 172 is coated with a PFA (perfluoroalkoxy) tube or a PFA or PTFE film of 30 to 50 μm thick as a releasing layer.

The pressure roller 173 is a soft roller of 40 to 60 mm in the outer diameter. For example, a preferred embodiment of the pressure roller 173 includes a cylindrical metallic pipe 173A made of aluminum of 2 to 5 mm thick, a rubber roller layer 173B of 1 to 5 mm thick made of, for example, silicone having a rubber hardness of 5 to 60 Hs (by JIS K6253 "A" rubber hardness (ISO48 7619)), and a releasing layer 173C made of a PFA (perfluoroalkoxy) tube of 15 to 50 μm thick which covers the rubber roller layer 173B. The pressure roller 173 can contain a halogen lamp HLa as a heating member inside the pressure roller 173.

While studying low-glossiness images, the inventors assumed what caused an image deviation during fixing as follows: If an under-offsetting takes place in the first pressure area P1 while a recording sheet having an unfixed toner image is sandwiched and delivered by the fixing belt 172 and the pressure roller 173, part of toner attaches to the fixing belt 172 instead of the recording sheet K between the first pressure area P1 and the second pressure area P2. This causes a slight speed difference or travel difference between the fixing belt 172 and the recording sheet K and deviates the unfixed toner. The fixed image is thus deviated on the recording sheet K.

From this assumption, the inventors provided a pressing means 174 that pushes the fixing belt 172 against the pressure roller 173 in the first pressure area to prevent an image deviation.

The pressing means 174 includes a pad 174A made of, for example, heat-resistant rubber sponge, alumina, or the like, compression springs 174B, and a pad support 174C. The compression springs cause the pads 174A to push the fixing belt 172 against the pressure roller 173 at a preset pressure.

The guide member 175 is made of a heat-resistant resin material such as polyimide or polyamide and has a function to guide the fixing belt 172 smoothly into the first pressure area P1.

The temperature sensor 176 which is a thermistor is provided in contact with or apart from the surface of the heating roller 171 to measure the surface temperature of the heating roller. Receiving the result of measurement, the temperature controlling means (not shown in the figure) controls to keep the heating roller 171 at a preset temperature.

The guide roller 177 is 30 to 50 mm in the outer diameter. A preferred embodiment of the guide roller 177 includes a cylindrical metallic pipe 177A made of SC steel (STKM) of 2 to 5 mm thick and a releasing layer 177B made of a PFA (perfluoroalkoxy) tube of 15 to 50 μm thick which covers the metallic pipe 177A.

Next will be explained a pressure changing member that can vary the mean pressure on the second pressing area P2.

Figure 3:
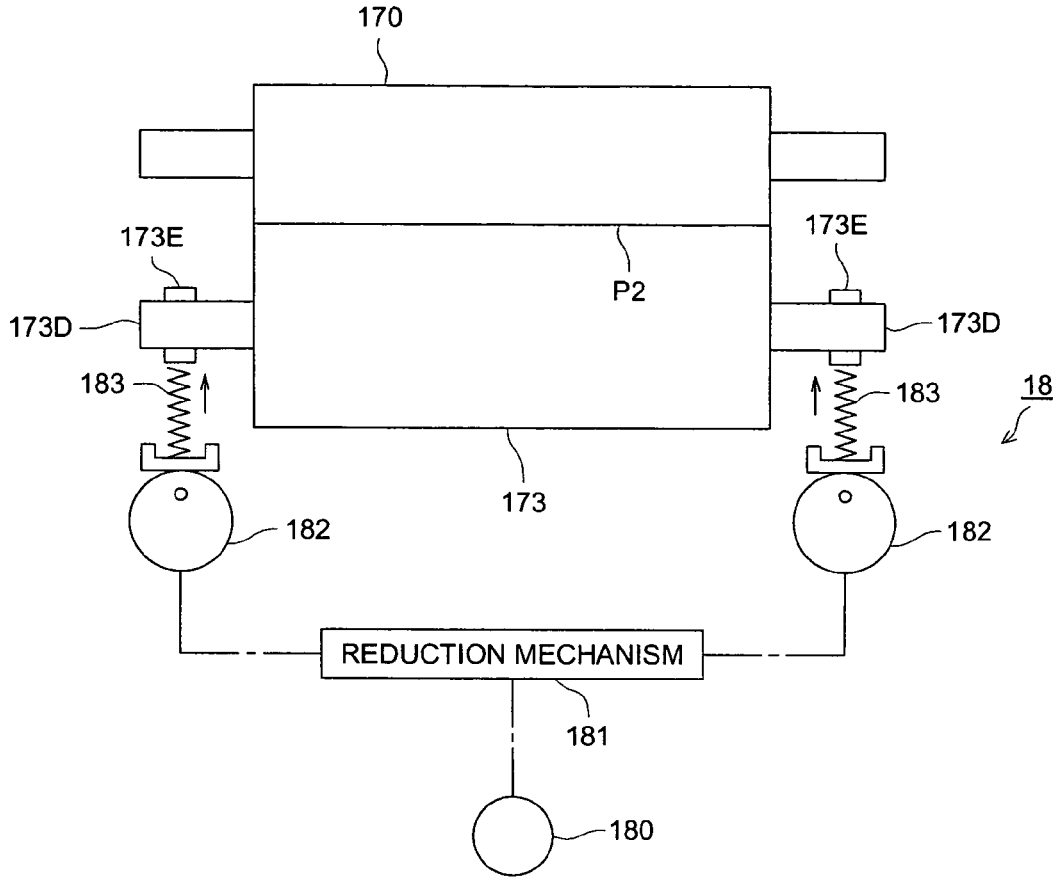
FIG. 3 is a schematic diagram of the pressure changing member.

FIG. 3 is a schematic diagram of the pressure changing member.

The pressure changing member 18 has an eccentric cam driving motor 180, a reduction mechanism 181, eccentric cams 182, and compression springs 183.

The eccentric cam driving motor 180 is for example a pulse motor, a servo motor, or the like and rotates the eccentric cams 182 via the reduction mechanism 181.

When rotating, the eccentric cams 182 move up and down (to and from the top of the page) the rotary shaft 173D of the pressure roller 173 by means of the compression springs 183 and the bearings. This can change the mean pressure on the nip area between the pressure roller 173 and the fixing roller 170, that is, the second pressure area P2.

The mean pressure on the second pressure area P2 is expressed by $$P=W/(L\times NP2)$$

where

W is a load that the pressure roller 173 gives to the fixing roller 170. L is the longitudinal length of the pressure roller 173. NP2 is the nip width of the second pressure area P2 (nip width in the periphery of the pressure roller 173).

The pressure roller 173, the pressing means 174, and the guide member 175 are supported by a common supporting member 178. Therefore, even when the pressure roller 173 is moved by the pressure changing member 18, the pressure roller 173, the pressing means 174, and the guide member 175 do not change their positional relationship and remain in a preset positional relationship.

Further, the guide roller 177 is arranged to move by a preset distance in the arrow direction as the pressure roller 173 moves. Therefore, even when the pressing means 174, and the guide member 175 move together with the pressure roller, the tension of the fixing belt 172 can remain unchanged.

The guide roller 177 is not explained here as its movement can be accomplished in the same manner as the pressure changing member 18.

It is possible to go without the guide roller 177 by setting an optimum spring constant (by reducing the spring constant) of the spring 171A that gives a tension to the fixing belt via the heating roller 171 and making the compression stroke of the spring great enough.

Below will be explained the fixing device 17 of the above configuration.

When the operator enters a desired degree of glossiness from the operating section 200 of the image forming apparatus GS, the control means (not shown in the figure) sends preset pulse information to the eccentric cam driving motor 180 of the pressure changing member 18 according to the entered glossiness instruction. The eccentric cam driving motor 180 rotates the eccentric cams 182 by the pulse information and moves the pressure roller 173 by a predetermined distance.

Immediately when the pressure roller 173 moves, the control means (not shown in the figure) moves the guide roller 177 by a preset distance by the entered glossiness instruction and thus keeps the tension of the fixing belt 172 constant.

As the pressure roller 173 and the guide roller 177 respectively move by the glossiness instruction, the mean pressure P on the second pressure area P2 can be changed and the pressure condition of the first pressure area can be kept constant.

Further when an external input device (not shown in the figure) is connected to the image forming apparatus, it can be designed to enter glossiness instructions from the external input device.

The inventors experimentally evaluated the glossiness control and relationships between under-offsetting and image deviation in the above-mentioned configuration of the image forming apparatus.

Figure 4:
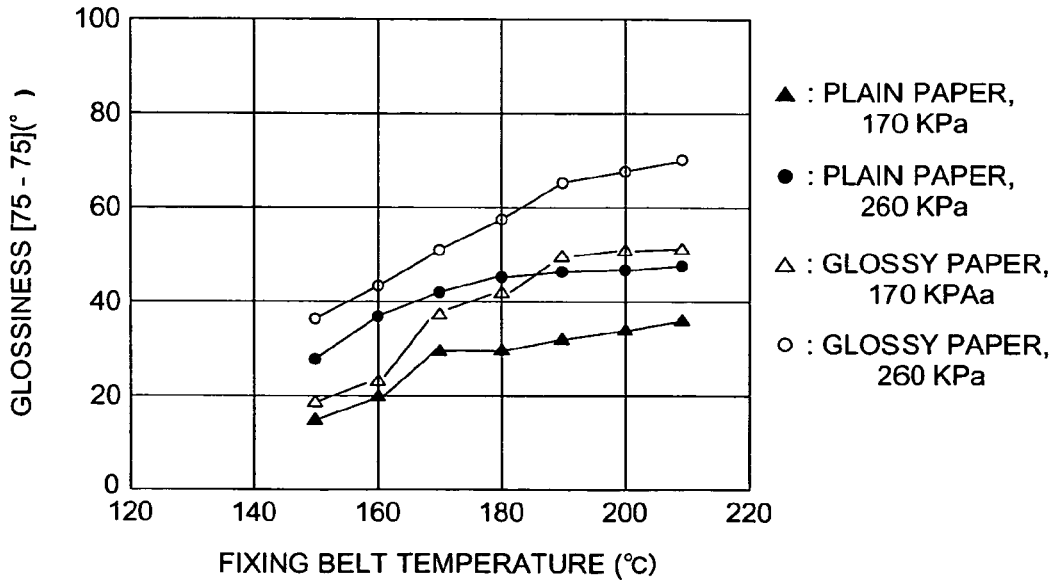
FIG. 4 graphically shows a relationship between glossiness and temperature of the fixing belt.

First, we'll explain the result of evaluation of glossiness control by referring to FIG. 4.

FIG. 4 graphically shows a relationship between glossiness and temperature of the fixing belt temperature (° C.) on plain and glossy recording sheets at two mean pressures (170 kPa and 260 kPa) on the second pressure area.

The "▲" plotting represents the result of experiment under a condition of a plain paper and a mean pressure of 170 kPa.

The "●" plotting represents the result of experiment under a condition of a plain paper and a mean pressure of 260 kPa.

The "Δ" plotting represents the result of experiment under a condition of a glossy paper and a mean pressure of 170 kPa.

The "○" plotting represents the result of experiment under a condition of a glossy paper and a mean pressure of 260 kPa.

Here, "glossiness" means a relative-specular glossiness of 75 Gs (75°) defined by JIS Z8741 (ISO2813) and can be measured for example by GMX-203 (manufactured by Murakami Color Laboratory) or Gardner 4554.

From FIG. 4, we can find that we can control the degree of glossiness widely by changing the mean pressure on the second pressure area independently of kinds of recording paper and fixing-belt temperatures.

Further we can find that we can control the degree of glossiness widely by combining mean pressures on the second pressure area and fixing-belt temperatures.

In the second pressure area, the toner and sheet temperatures become highest. This easily deforms the toner layer and causes molten toner to go into sheet fibers. If the mean pressure on the second pressure area is made too low, the toner layer cannot follow the unevenness of the sheet and this may cause uneven brightness.

We found that we can get uniform images that are visually acceptable even on uncoated recording sheets for use in normal electrostatic image forming apparatus by making the mean pressure 150 kPa or higher.

We also found that the durability of the roller rubber is strikingly deteriorated when the mean pressure exceeds 500 kPa.

Figure 5:
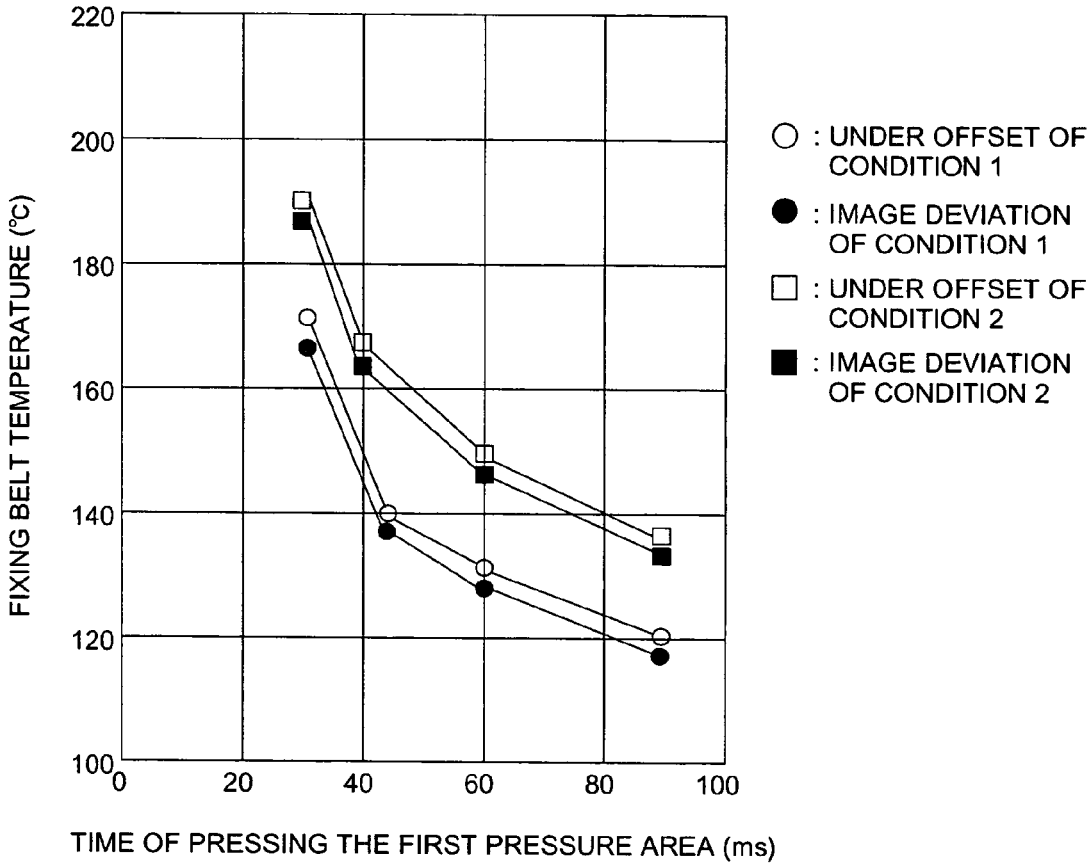
FIG. 5 graphically shows how under-offsetting and image misalignment change by the fixing belt temperature and the pressing time of the first pressure area.

Next, we'll explain the result of experiments related to the relationship between under-offsetting and image deviation with reference to FIG. 5.

FIG. 5 plots points at which under-offsetting and image-deviation are suppressed in the combination of a time period (ms) of pressing the first pressure area and a fixing belt temperature (° C.) under two conditions of pressure width and load of the pad 174A of the pressing means 174.

As we cannot check the under-offset status in the system configuration of FIG. 1, we released the pressure roller 173, moved the pad 174A and the guide member 175 toward the pressure roller 173 to form the first pressure area only before the experiment.

Condition 1:

Pad thickness 3 mm

Pressure width (peripheral length of the pressure roller) 6.5 mm

Longitudinal length of the pressure roller 350 mm

Load on the pad 150 N

Condition 2:

Pad thickness 6 mm

Pressure width (peripheral length of the pressure roller) 10 mm

Longitudinal length of the pressure roller 350 mm

Load on the pad 240 N

Here, the pressure time is the result obtained by dividing the above pressure width by a linear velocity of the fixing belt. A heat-resistant rubber sponge is used as the pads.

The "●" plotting represents points at which image deviations are suppressed under condition 1

The "○" plotting represents points at which under-offsetting is suppressed under condition 1

The "■" plotting represents points at which image deviations are suppressed under condition 2

The "□" plotting represents points at which under-offsetting is suppressed under condition 2.

As seen from FIG. 5, the under offsetting and image deviations are suppressed almost at the same points. Therefore, we confirmed that we could suppress image deviations by setting the fixing condition of the first pressure area to a condition of suppressing under-offsetting.

Therefore we can get images free of under-offsetting, image deviation, and uneven brightness by setting a condition of suppressing under-offsetting in the first pressure area and setting a mean pressure of 150 kPa or higher on the second pressure area.

We evaluated under-offsetting as follows:

Step 1: Release the second pressure area.

Step 2: Form a test toner image on a recording sheet which is longer than the peripheral length of the fixing belt.

Step 3: Fix the recording sheet in the first pressure area.

Step 4: Visually check the adhesion of toner for the test toner image to the recording sheet at a position downstream from the toner image by a distance of the peripheral length of the fixing belt.

The image deviation in the fixed image is visually checked after a normal fixing operation.

The image forming apparatus of this invention has the effects below.

As the fixing area includes the first and second pressure areas, the image forming apparatus of this invention can give a fixing property in the first pressure area and glossiness in the second pressure area. Therefore, we can control the glossiness quickly and widely by changing the mean pressure of the second pressure area.

The image forming apparatus of this invention can suppress uneven brightness by setting the low mean pressure limit of the second pressure area to 150 kPa.

The image forming apparatus of this invention can easily form images of desired glossiness by glossiness instructions.

The image forming apparatus of this invention can suppress image deviations by setting an under-offset suppressing condition as the fixing condition of the first pressure area.

By providing a pressure member in the first pressure area, the image forming apparatus of this invention can eliminate a difference in speed between the fixing belt and the pressure roller and thus suppress image deviations.

By keeping the positional relationship of the pressure roller, the guide member, and the pressure member, it is possible to keep the condition of pressing the first pressure area constant even when the pressure roller is moved to change the mean pressure on the second pressure area.

What is claimed is:

1. An image forming apparatus having a fixing device for fixing toner image formed on a sheet by an endless fixing belt engaged with a fixing roller comprising:

a pressing roller opposite to the fixing roller through the endless fixing belt; wherein a pressure area provided between the endless fixing belt and the fixing roller has a first pressure area in contact with the fixing belt where the pressing roller does not press the fixing belt against the fixing roller and a second pressure area which is provided in the downstream side of the first pressure area in the movement of a recording sheet and pressed the fixing roller through the endless fixing belt by the pressing roller, and a pressure changing member that varies the pressure on the second pressure area with the pressing roller so that the pressure is increased for higher gloss.

2. The image forming apparatus of claim 1, wherein the mean pressure on the second pressure area is 150 kPa or more.

3. The image forming apparatus of claim 1, further comprising an operating section from which image forming conditions are entered and a controller for controlling the pressure changing member according to a glossiness command entered from the operating section or an external input apparatus connected to the image forming apparatus.

4. The image forming apparatus of claim 1, wherein the image forming apparatus controls the fixing condition to suppress under-offsetting in the first pressure area.

5. The image forming apparatus of claim 1, further comprising a pressure member for pressing the endless fixing belt against the pressing roller in the first pressure area.

6. The image forming apparatus of claim 5, further comprising a guide member with which the endless fixing belt is engaged, wherein the pressure roller, the guide member, and the pressure member are arranged to keep each position in spite of the movement of the pressure roller by the pressure changing member.

7. The image forming apparatus of claim 6, further comprising a common supporting member for supporting the pressure roller, the guide member, and the pressure member.

8. The image forming apparatus of claim 6, further comprising a movable guide roller with which the endless fixing belt is engaged, wherein the movable guide roller moves a predetermined distance according to a moving distance of the pressure roller moved by the pressure changing member.

9. The image forming apparatus of claim 1, wherein the pressure changing member changes a position of the pressure roller to the fixing roller.

10. The image forming apparatus of claim 9, wherein the pressure changing member is equipped with an eccentric cam and a motor to drive the eccentric cam and the eccentric cam driven by the motor changes a position of a rotary shaft of the pressure roller to the fixing roller.

11. The image forming apparatus of claim 1, further comprising a variable-temperature heater for heating the endless fixing belt.

12. An image forming apparatus having a fixing device for fixing toner image formed on a sheet by an endless fixing belt engaged with a fixing roller comprising:

a pressing roller opposite to the fixing roller through the endless fixing belt, wherein a pressure area provided between the endless fixing belt and the fixing roller has a first pressure area in contact with the fixing belt where the pressing roller does not press the fixing belt against the fixing roller and a second pressure area which is provided in the downstream side of the first pressure area in the movement of a recording sheet and pressed the fixing roller through the endless fixing belt by the pressing roller, and after the toner image is fixed with a fixing condition controlled to suppress under-offsetting in the first pressure area, the toner image is fixed in the second pressure area.

13. A fixing device for fixing toner image formed on a sheet by an endless fixing belt engaged with a fixing roller comprising a pressing roller opposite to the fixing roller through the endless fixing belt; wherein a pressure area provided between the endless fixing belt and the fixing roller has a first pressure area in contact with the fixing belt where the pressing roller does not press the fixing belt against the fixing roller and a second pressure area which is provided in the downstream side of the first pressure area in the movement of a recording sheet and pressed the fixing roller through the endless fixing belt by the pressing roller, and a pressure changing member that varies the pressure on the second pressure area with the pressing roller so that the pressure is increased for higher gloss.

14. The fixing device of claim 13, wherein the mean pressure on the second pressure area is 150 kPa or more.

15. The fixing device of claim 13, further comprising a pressure member for pressing the endless fixing belt against the pressing roller in the first pressure area.

16. The fixing device of claim 15, further comprising a guide member with which the endless fixing belt is engaged, wherein the pressure roller, the guide member, and the pressure member are arranged to keep each position in spite of the movement of the pressure roller by the pressure changing member.

17. The fixing device of claim 16, further comprising a common supporting member for supporting the pressure roller, the guide member, and the pressure member.

18. The fixing device of claim 16, further comprising a movable guide roller with which the endless fixing belt is engaged, wherein the movable guide roller moves a predetermined distance according to a moving distance of the pressure roller moved by the pressure changing member.

19. The fixing device of claim 13, wherein the pressure changing member changes a position of the pressure roller to the fixing roller.

20. The fixing device of claim 19, wherein the pressure changing member is equipped with an eccentric cam and a motor to drive the eccentric cam and the eccentric cam driven by the motor changes a position of a rotary shaft of the pressure roller to the fixing roller.

* * * * *